United States Patent [19]

Nelson

[11] Patent Number: 4,954,078

[45] Date of Patent: Sep. 4, 1990

[54] SPARK IGNITER SYSTEM

[75] Inventor: John M. Nelson, Brockport, N.Y.

[73] Assignee: Newell Companies, Inc., Freeport, Ill.

[21] Appl. No.: 839,901

[22] Filed: Mar. 14, 1986

[51] Int. Cl.[5] ..... F23Q 3/00

[52] U.S. Cl. ..... 431/255; 431/266; 313/123; 315/209 PZ

[58] Field of Search ..... 431/264, 266, 255; 313/123, 124; 315/209 PZ

[56] References Cited

U.S. PATENT DOCUMENTS

| | | | |
|---|---|---|---|
| 1,479,575 | 1/1924 | Adams et al. | 313/123 |
| 3,229,153 | 1/1966 | Freeman | 315/209 PZ |
| 4,046,127 | 9/1977 | Almquist et al. | 313/123 |
| 4,526,532 | 7/1985 | Nelson | 431/255 |

*Primary Examiner*—Carroll B. Dority
*Attorney, Agent, or Firm*—Michael L. Dunn

[57] ABSTRACT

A spark igniter circuit is provided for igniting a flammable gas mixture in devices such as gas torches, lanterns, stoves and the like. A piezoelectric spark generator imposes a voltage on an electrically conductive circuit which is discontinuous in two locations for creating a pair of spark gaps in the circuit. The first spark gap eliminates the need of stripping insulation from a pair of wires and providing a connector therebetween and possibly enhances the effectiveness of a spark at the second spark gap for igniting the gas mixture.

6 Claims, 1 Drawing Sheet

SPARK IGNITER SYSTEM

This invention relates to a spark igniter system and more particularly to a spark igniter circuit which is useful for gas-fired devices such as torches, stoves, lanterns and the like.

RELATED PATENT APPLICATION

The present invention is useful in the apparatus disclosed in a copending application filed Mar. 14, 1986 and now U.S. Pat. No. 4,666,39 by the inventor, John M. Nelson, and entitled Low Pressure Gas Torch Burner; the disclosure in the copending application is incorporated herein by reference.

BACKGROUND OF THE INVENTION

Spark igniters have heretofore been disclosed in use with similar devices in U.S. Pat. Nos. 4,013,395 (A. F. Wormser), 4,348,172 (H. C. Miller), 4,526,532 (J. M. Nelson) and 3,843,311 (J. M. Nelson) wherein an electrical circuit is provided to generate a spark for igniting a flammable gas mixture.

In devices of the prior art, such as the propane gas hand torch shown in U.S. Pat. Nos. 4,348,172 and 4,526,532, a piezoelectric igniter is used for creating a spark for igniting flammable gas in the burner tube portion of the device. In each of the patented devices, only a single spark is generated in the electrical circuit; the spark is generated within the burner tube through use of an electrical wire whixh is disposed either along the outside of the burner tube as in the first mentioned patent, or an electrical wire whixh is introduced to the inside of the burner tube along the length thereof such as is disclosed in the second mentioned patent.

SUMMARY OF THE INVENTION

It is a primary object of the invention to provide a spark igniter circuit wherein the circuit includes a voltage source, a first conductor, a second conductor and a third conductor, the first conductor being electrically connected to one side of the voltage source, the second conductor being electrically connected to the other side of the voltage source, and the first and second conductors each having a portion thereof spaced from opposite ends of the third conductor for providing a first spark gap between the first and third conductors and a second spark gap between the third and second conductors.

Another object of the invention is to provide a spark igniter circuit, as described above, wherein the voltage source is a piezoelectric igniter.

A still further object of the invention is to provide a circuit, as defined above, wherein the piezoelectric igniter generates a voltage in the range of about 12 to 17 kilovolts.

Another object of the invention is to provide a spark igniter circuit, as defined above, wherein each of the first conductor and the third conductor is comprised of an electrically conductive wire and each wire is encased in electrical insulation except at the ends thereof, and two of the ends are spaced from each other a distance determined by the electrical insulation for providing the first spark gap between the two ends of the wires. This feature of the invention obviates any necessity for individually stripping insulation from the ends of the wires and also obviates any need for incurring the cost of a connector for the wires and the cost of assembling such connector to the ends of the separate wires.

A further object of the invention is to provide a spark igniter circuit, as described above, in combination with a gasfired device, the device including gas delivery means for passing a flammable gas mixture in the vicinity of the second spark gap whereby voltage from the voltage source will generate a spark at the second spark gap and ignite the flammable gas.

A still further object of the invention is to provide a spark igniter circuit in combination with a gas-fired device wherein a spark generated at the second spark gap is possibly enhanced because of the presence of the first spark gap in the electrical circuit.

DETAILED DESCRIPTION OF THE INVENTI0N

Figure 1:
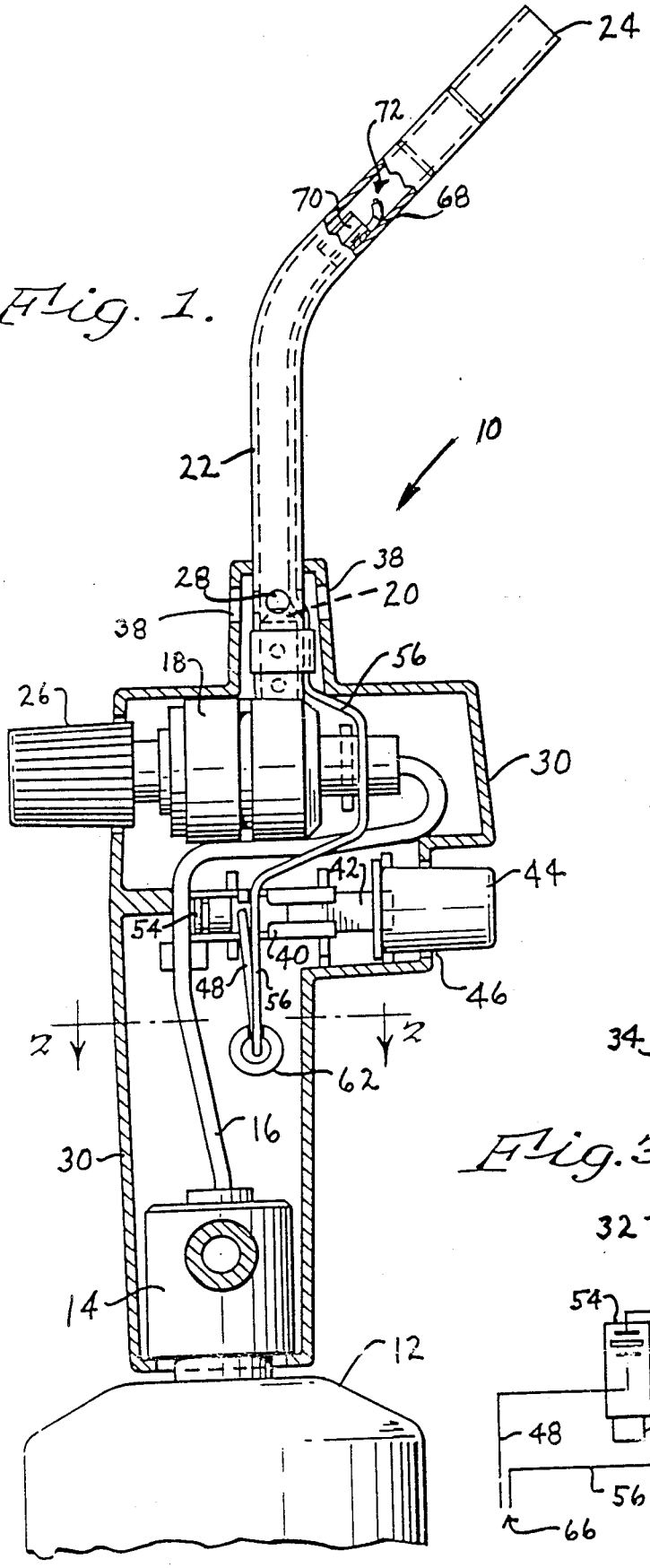
FIG. 1 is a view, partly in section, and illustrates the invention as being incorporated into a hand-held gas torch which is shown connected to a source of pressurized gas.

The spark igniter circuit which constitutes the present invention is shown in a preferred embodiment as being useful in connection with a portable gas hand torch, generally indicated by the numeral 10, which is supplied with a flammable gas, such as propane or the like, from a gas cartridge 12. Gas cartridges 12 are widely used, well known and available from Bernzomatic, Medina, N.Y., and identified by Stock No. TX-9 and TX-9C.

Torch 10 is connected to gas cartridge 12 by a threaded coupling 14 through which flammable gas passes in a known manner through a fuel supply line 16 to a pressure regulator 18 and exits through an orifice member 20 into a burner member 22 and out of a burner tip 24.

A fresh gas cartridge 12 usually contains a gas under a pressure of about 110 psig. Pressure regulator 18 includes an adjustment knob 26 which is rotatable from an "off" position to a "open" position so that the flammable gas exits through orifice member 20 at a pressure in the range of 27 to 31 psig and, preferably, at 29 psig. The burner member or tube 22 is provided with a series of openings 28, usually four in number, equally spaced about the burner tube 22 so that the pressurized jet of gas exiting from orifice member 20 causes ambient air to be aspirated into tube 22 through the openings 28 for forming a combustible gas mixture which moves through burner tube 22 and exits through burner tip 24.

Figure 2:
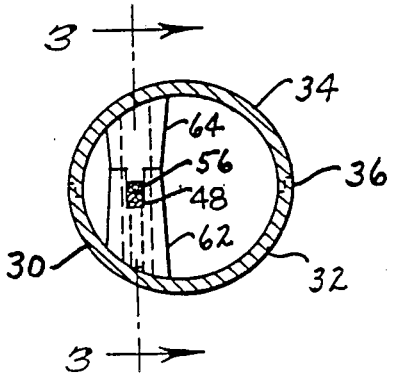
FIG. 2 is a sectional view, taken on line 2—2 of FIG. 1, and illustrates a pair of mating bosses for securing a pair of electrical wires.

The torch 10 is enclosed within mating halves of a molded cover or case 30 constructed from a durable plastic such as cycolac or a similar ABS resin. As is best shown in FIG. 2, a lower half 32 and an upper half 34, of case 30, may be joined by ultrasonic welding along a central portion 36. The case 30 encloses most of the torch 10 but is provided with openings for fitting cartridge 12 to coupling 14 and for allowing adjustment knob 26 to protrude therefrom. Further, case 30 includes a plurality of air vents 38 for allowing ambient air to flow into openings 28 and burner tube 22 under the influence of the jet of pressurized gas exiting from orifice member 20.

Figure 3:
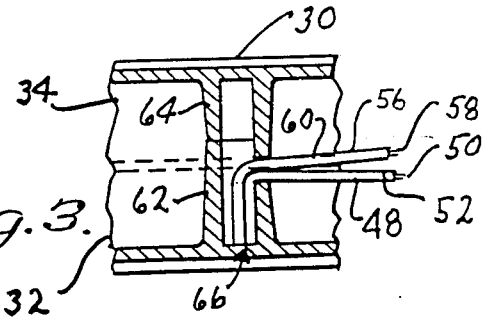
FIG. 3 is a sectional view, taken on line 3—3 of FIG. 2, and illustrates a manner of juxtaposing the ends of two wires for providing a spark gap therebetween.

Torch 10 is provided with a spark igniter circuit comprised of a piezoelectric igniter 40 which constitutes a voltage source for providing a voltage in the range of 12 to 17 kilovolts. Piezoelectric igniter 40 is well known in the art as exemplified by U.S. Pat. Nos. 4,348,172 and 4,526,532; the particular igniter shown in FIG. 1 is one designated as RION MODEL TS-95S 063 available from Universal Trading Company, 4—4 Yayoi, 2-chome, Bunkyo-ku, Tokyo, Japan. Igniter 40 includes a spring-loaded plunger 42 which is actuated by squeezing a trigger 44 into case 30 through an opening 46. Actuation of igniter 40 causes a current to flow out through an attached conductor 48; as is best illustrated in FIGS. 2 and 3, conductor 48 is comprised of an electrically conductive wire 50 surrounded by insulation 52 made of rubber or similar material and having an outside diameter on the order of 0.100 inch. Igniter 40 has its other electrical connection, for return of the electric current, through a conductor circuit comprised of a metal base 54 in electrical contact with fuel supply line 16, regulator 18 and burner tube 22, all of which are made of electrically conductive metal.

Another conductor 56 is, as best illustrated in FIGS. 2 and 3, comprised of an electrically conductive wire 58 encased within insulation 60.

Figure 4:
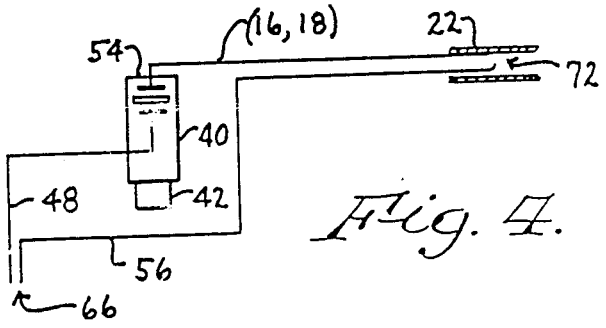
FIG. 4 is a schematic view illustrating a circuit wherein a piezoelectric spark igniter is provided in an electric circuit which includes a pair of spark gaps.

Conductor 48 and conductor 56 have their ends bottomed in a boss 62 formed on the lower half 32 of case 30 and held therein by a pillar 64 formed on the upper half 34 of case 30. It is a particularly important aspect of the present invention to carefully note that the ends of conductors 48 and 56 are merely bottomed in boss 62, as is best shown in FIG. 3, and the wires 50 and 58 are not connected to each other. As a matter of fact, the wires are spaced from each other desirably by the thickness of the insulation 52 and 60. The preferred specifications for conductor 56 is that it be 7/28–20 American Wire Gauge, the insulation 60 being a fluoroethylene polymer (FEP) and having an outside diameter of $0.0600 \pm 0.002$ inch. As previously pointed out above, the preferred outside diameter of insulation 52 is 0.100 inch. It will therefore be seen that wire 50 and wire 58 are spaced by the insulation 52 and 60 to provide a spark gap 66 at the bottom of boss 62, as is best illustrated by the arrows in FIGS. 3 and 4.

As is best shown in FIG. 1, conductor 56 extends from boss 62 and enters burner tube 22 through one of the openings 28 and has its free end 68 secured on the axial center line of burner tube 22 by a clip 70. It is preferred that free end 68 be spaced from burner tube 22 by a distance of $0.135 \pm 0.010$ inch to provide a second spark gap 72 which is illustrated by the arrows in FIGS. 1 and 4.

Operation of torch 10 is accomplished by first rotating adjustment knob 26 to provide a flow of gas from cartridge 12 through fuel supply lines 16, pressure regulator 18 and orifice member 20 such that the gas forms a combustible mixture with air entering the openings 28. The mixture then flows through burner tube 22 and past the spark gap 72. At this time, trigger 44 is squeezed to operate plunger 42 of the piezoelectric igniter 40. The applied voltage causes current to flow in conductor 48 and jump the spark gap 66. The current then continues through conductor 56 and jumps the spark gap 72 and returns to the igniter 40 through the burner tube 22, regulator 18, fuel supply line 16 and metal base 54.

It is to be understood that the disclosed spark igniter circuit is useful in environments other than the disclosed hand torch and that various modifications and changes may be made without departing from the spirit and scope of the invention as defined in the following claimed subject matter.

What is claimed is:

1. A portable gas hand torch assembly comprising a burner tube and a gas delivery means for directing a flammable gas mixture through said burner tube, said torch assembly further comprising a spark igniter circuit which includes a piezoelectric voltage source, a first conductor, a second conductor and a third conductor, said first conductor being electrically connected to one side of said voltage source, said second conductor being electrically connected to the other side of said voltage source, and said first and second conductors each having a portion thereof spaced from opposite ends of said third conductor for providing a first spark gap between said first and third conductors and a second spark gap between said third and second conductors, said first conductor and said third conductors comprising an electrically conductive wire and each wire being encased in electrical insulation except at the ends thereof, and two of said ends being spaced from each other at a minimum distance determined by said electrical insulation for providing said first spark gap between said two ends, said second spark gap being disposed in the path of said flammable gas mixture whereby voltage from said voltage source will generate a spark at said second spark gap to ignite the flammable gas mixture.

2. A torch as defined in claim 1 wherein said spaced ends are spaced in a range of about 0.035 to 0.050 inch from center-to-center.

3. A torch as defined in claim 2 wherein said second spark gap is about 0.137 to 0.197 inch.

4. A torch as defined in claim 3 wherein said voltage source includes means for generating an output in the range of about 12 to 17 kilovolts.

5. A torch as defined in claim 1 wherein said portable gas hand torch assembly includes means for connecting said hand torch to a pressurized gas fuel supply.

6. A torch as defined in claim 2 wherein said torch comprises a case which holds the piezoelectric voltage source and acts as a torch handle, said case including means for retaining said two of said ends of the first and third conductors proximate each other to obtain the spacing of from about 0.035 to 0.050 inch from center-to-center.

* * * * *